United States Patent [19]

Nixon et al.

[11] 4,098,410

[45] Jul. 4, 1978

[54] SAFE LOAD INDICATOR FOR JIB CRANES

[75] Inventors: Brian George Nixon, Twickenham; Ian William Stimpson, Yateley, near Camberley, both of England

[73] Assignee: Weighload Limited, London, England

[21] Appl. No.: 768,731

[22] Filed: Feb. 15, 1977

[30] Foreign Application Priority Data

Feb. 25, 1976 [GB] United Kingdom ..... 07446/76

[51] Int. Cl.[2] ..... B66C 13/48

[52] U.S. Cl. ..... 212/39 MS; 340/685

[58] Field of Search ..... 212/55, 34 R, 39 MS; 340/267 C; 116/124 F

[56] References Cited

U.S. PATENT DOCUMENTS

| | | | |
|---|---|---|---|
| 3,148,659 | 9/1964 | Artken | 212/39 MS |
| 3,828,339 | 8/1974 | Schedrovitsky et al. | 212/39 MS |
| 3,990,584 | 11/1976 | Strawson et al. | 212/39 MS |

FOREIGN PATENT DOCUMENTS

| | | | |
|---|---|---|---|
| 993,954 | 6/1965 | United Kingdom | 212/39 MS |
| 1,119,485 | 7/1968 | United Kingdom | 212/39 MS |
| 1,310,012 | 3/1973 | United Kingdom | 212/39 MS |
| 1,440,581 | 6/1976 | United Kingdom | 212/39 MS |

*Primary Examiner*—Lawrence J. Oresky
*Attorney, Agent, or Firm*—Watson, Cole, Grindle & Watson

[57] ABSTRACT

An overload warning device for use in a crane having a telescopic jib which includes, in a transmission between a slave jib and a pointer, a bank of cams each appropriate for a different length of jib, a common follower cooperable with the cams, and a selector mechanism operable automatically in response to change in the jib length for effecting relative movement between the follower and the cams to bring the follower into cooperation with the cam corresponding to the newly selected jib length.

6 Claims, 4 Drawing Figures

0
5
10
15
20
25
17
18
19
20
59
47
46
48
58
44
43
39
45
49
53
54
M2
41
50
38
51
30
28
M1
55
26
60
26
34
36
37
31
27
35
56
57
38
40
42
30

SAFE LOAD INDICATOR FOR JIB CRANES

This invention relates to an overload warning device for a luffing crane, of the type described in British Pat. No. 993,954 and herein referred to as the type specified, comprising a first pointer controlled by a device for measuring the load suspended from the jib of the crane and movable along a scale to indicate the load, a slave jib adapted to move angularly with the jib to positions representative of the working radius of the jib, and mechanism, including a cam and a cooperating follower, for moving a second pointer along the scale in response to increase in working radius in the opposite direction to that in which the first pointer moves in response to increase in load, and means operable by approach of the two pointers to issue a warning signal when an overload condition is approached. The device described in British Pat. No. 993,954 includes a single cam so formed that the position of the second pointer on the scale indicates the load at which a warning signal should be issued for any particular working radius of the crane.

Most cranes are provided with tables of working load figures appropriate for different conditions of operation of the crane and when compliance with a different table is required it is necessary to replace the cam by another suited to the new conditions.

In British Pat. No. 1,119,485 we have described an improved form of overload warning device for use with a crane having a telescopic jib including a movable upward extension and providing for automatic adjustment of the coupling between the slave jib and the second pointer to compensate for change in the length of the jib. With this device it is also necessary to effect manual interchange of cams from time to time to suit changes in working conditions.

The present invention provides an improved overload warning device of the type specified for use in a crane having a telescopic jib which includes, in the transmission between the slave jib and the second pointer, a bank of cams each appropriate for a different length of jib, a common follower cooperable with the cams, and a selector mechanism operable automatically in response to change in the jib length for effecting relative movement between the follower and the cams to bring the follower into cooperation with the cam corresponding to the newly selected jib length.

Preferably the selector mechanism is electrical and includes a first electric motor which operates in response to change in length of the jib to separate the cams from the follower, a second electric motor which operates to effect relative movement between the follower and the bank of cams and switching mechanism for stopping both motors when the follower arrives opposite the cam corresponding to the new jib length.

One embodiment of the invention will now be described in detail, by way of example, with reference to the accompanying drawings, in which.

Figure 1:
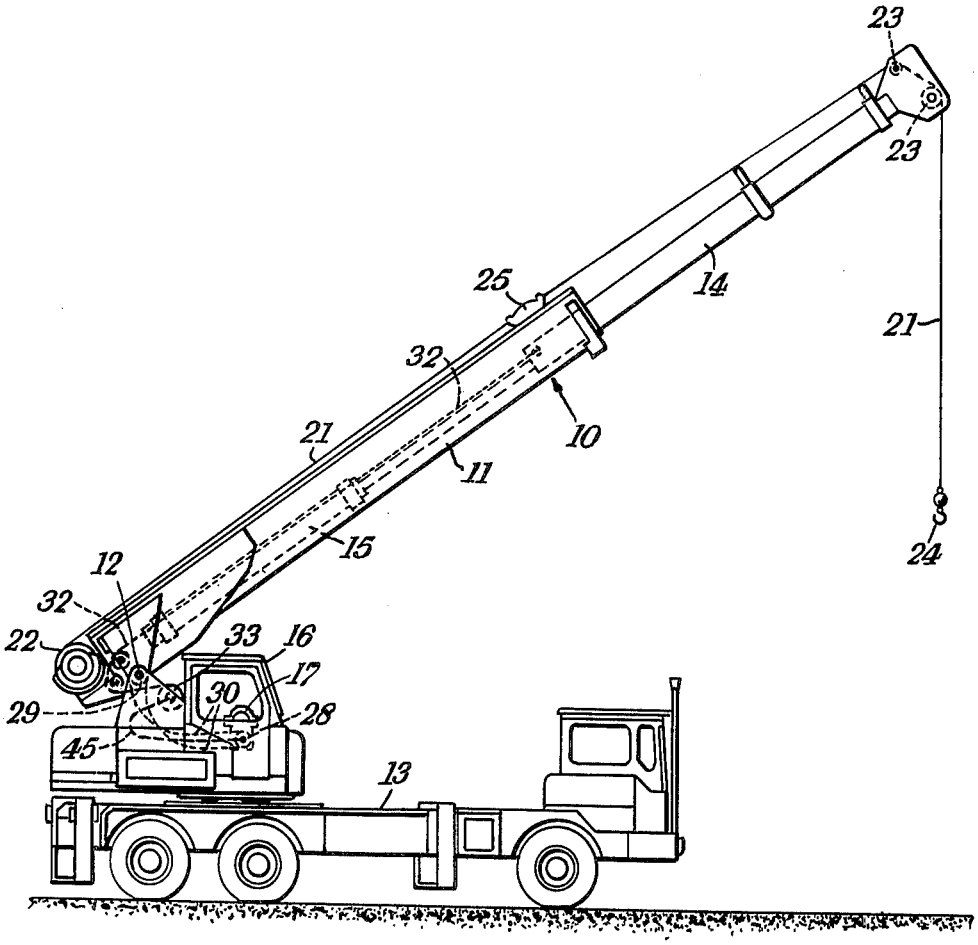
FIG. 1 is a side elevation of a mobile luffing crane.

The crane 10 shown in FIG. 1 has a telescopic jib, consisting of a lower section 11 pivoted at 12 to a wheeled carriage 13 and a top extension 14 which is movable lengthwise with respect to the lower section 11 by a hydraulic actuator 15, operable by the crane operator who occupies a cabin 16. The crane is provided with an overload indicator described below which is housed in a control box 17 (FIGS. 2 and 3) in the cabin.

As in the case of British Pat. No. 993,954, the overload indicator includes two pointers 18, 19 (FIG. 2) which move in opposite directions over a scale 20 calibrated in terms of the load suspended from the rope 21 (FIG. 1) of the crane. The rope 21 extends from a winding drum 22 over pulleys 23 and carries a hook 24 for supporting the load.

Figure 2:
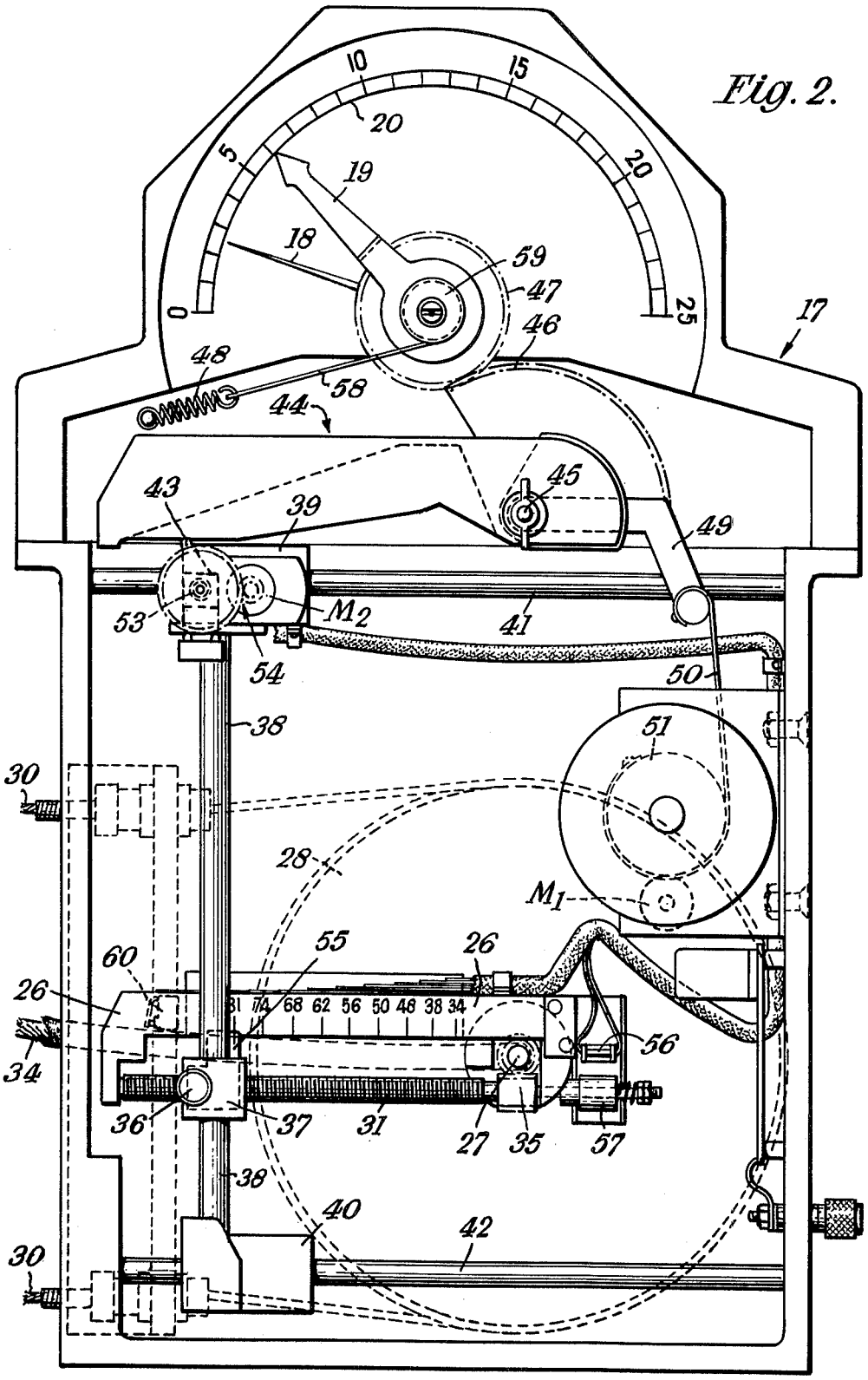
FIG. 2 is a longitudinal section of a control box housed within the cabin of the crane.
Figure 3:
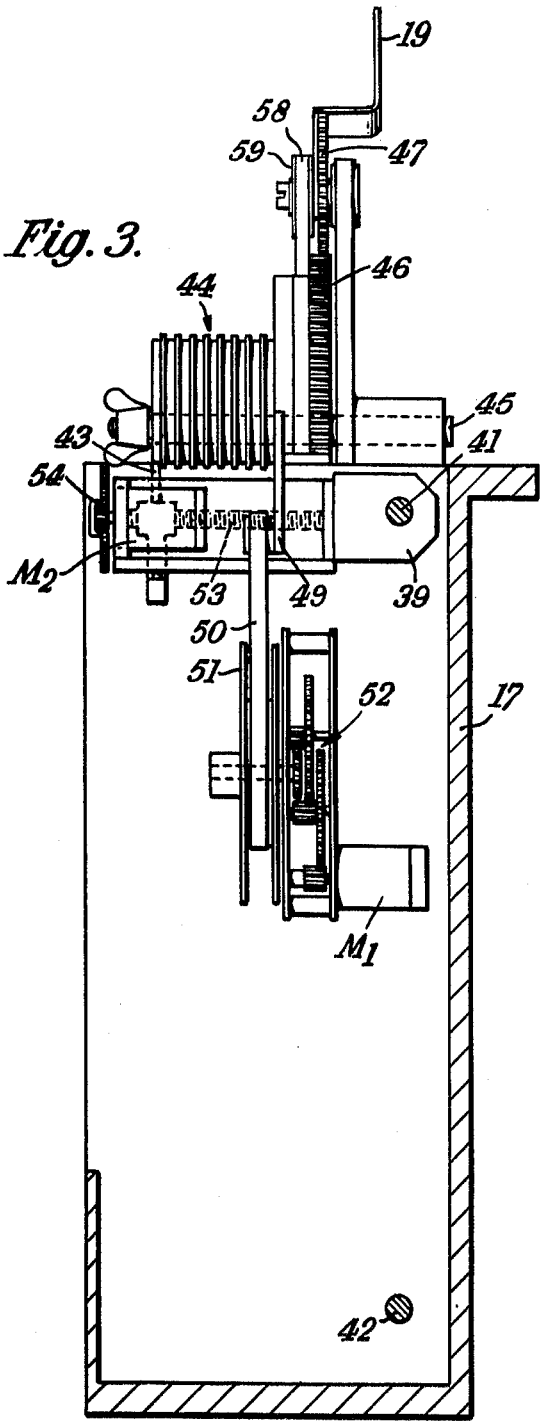
FIG. 3 is a corresponding cross section.

The load on the rope is measured by a dynamometer 25 mounted on the jib. As described in British Pat. No. 993,954 the dynamometer includes a hydrostatic load cell which is connected to a pressure gauge for actuating the pointer 18, so that the pointer 18 will move clockwise over the scale 20, as seen in FIG. 2, in response to increase in the load on the rope 21. The pointer 19 is moved counter clockwise over the scale 20 in response to increase in the working radius of the crane as described below. The indicator includes electrical controls, now shown, which operate as described in British Pat. No. 993,954 to light a warning lamp upon approach of the pointers 18, 19 and to ring a bell upon further approach of the pointers.

The control box 17 contains a slave jib 26, mounted on a shaft 27 carrying a pulley 28, which is connected to a pulley 29 (FIG. 1) on the jib by a flexible drive constituted by Bowden cables 30. The slave jib 26 accordingly moves with the jib and maintains the same angle to the vertical as the jib.

A lead screw 31 is rotatably mounted in the slave jib 26. The extension 14 (FIG. 1) of the jib is connected by a cable 32 to a spring drum 33, which is accordingly rotated by movement of the extension into and out of the lower section 11 of the jib and is connected by a flexible drive 34 and a skew gear 35 to the lead screw 31 which is thus rotated in accordance with the movements imparted to the extension 14. The lead screw 31 engages a nut pivoted by a pin 36 to a block 37, which is slidably mounted on a bar 38 joining upper and lower slides 39, 40 which are mounted to slide on respective bars 41, 42.

Accordingly pivotal movement of the slave jib 26 and rotation of the lead screw 31 are effective to impart lateral movement to the bar 38 to traverse the slides 39, 40 along their respective bars 41, 42 and so to traverse a follower 43 along that one of a bank of cams 44 with which the follower is in contact. The cams 44 are mounted on a common shaft 45, carrying a quadrant 46 which meshes with a gear 47 attached to the pointer 19. A spring 48 is connected by a tape 58 to a pulley 59 attached to the gear 47 and urges the cams 44 towards the follower 43. Movement of the follower 43 along the particular cam 44 disposed in contact with it causes the cam to pivot and to impart, through the quadrant 46 and the gear 47, movement to the pointer 19 determined by the contour of the cam.

The shaft 45 carries an arm 49, connected by a tape 50 to a drum 51, which is rotatable through gearing 52 (FIG. 3) by an electric motor $M_1$ to lift the cams 44 from the follower 43 as later explained.

The slide 39 carries a lead screw 53 which is operable through gearing 54 by another motor $M_2$ to traverse the follower 43 across the bank of cams 44 in response to variations in length of the jib. The block 37 carries a contact carrier 55 which cooperates with contacts on a switch plate on the slave jib 26 to close contacts, indicated at Ba-Bh in FIG. 4 positioned in correspondence with different jib lengths. The follower 43 is arranged to close corresponding contacts Ca–Ch as it moves to positions corresponding to newly selected jib lengths.

Figure 4:
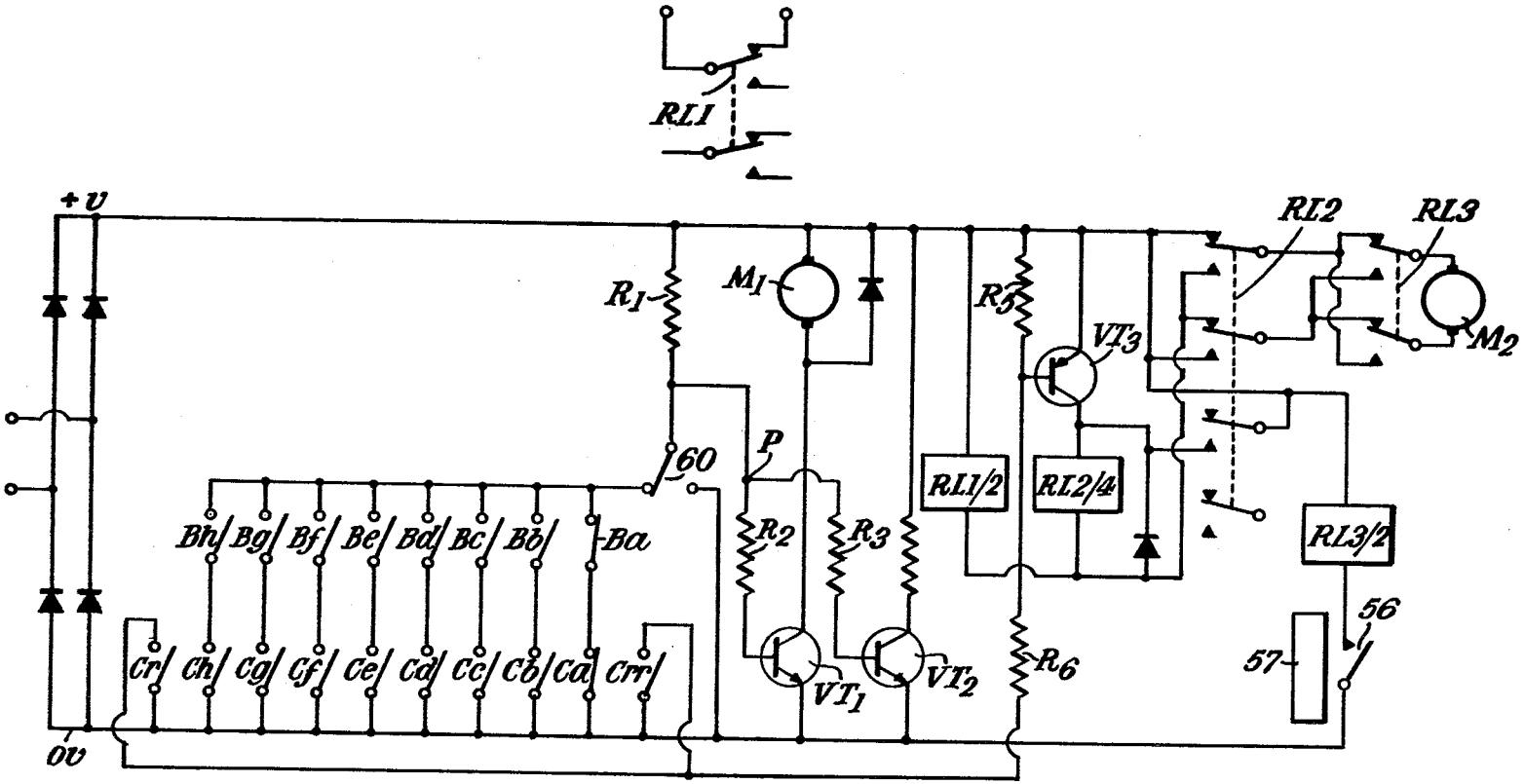
FIG. 4 is an electrical circuit diagram.

When the system is at rest, with the cam corresponding to the jib length in use selected, the corresponding contacts of the B and C banks, e.g. Ba and Ca, will be closed as shown in FIG. 4. The point P at the junction of resistors $R_1$, $R_2$ and $R_3$ is accordingly connected to the Ov supply line and transistors $VT_1$, $VT_2$ and $VT_3$ do not conduct.

When, however, an adjustment in jib length is made the contact Ba will open and the resultant rise in potential of the point P will switch on the transistors $VT_1$ and $VT_2$ to supply power to the motors $M_1$ and $M_2$, so lifting the cams 44 from the follower 43 and causing the follower to be traversed with respect to the cams. The motor $M_2$ causes the follower 43 to traverse in the correct direction, according to whether the jib is being lengthened or shortened, under control of a direction relay RL3/2 and associated contacts RL3 controlled by the direction of rotation of the lead screw 31, through the agency of a reed switch 56. This is controlled by a magnet 57 (see also FIG. 2) attached to a low friction clutch assembly which rotates between two mechanical stops. At one stop the magnet 57 closes the switch 56 to energize the relay RL3/2 and at the other it does not. The contacts RL3 respond to effect appropriate change in the direction of rotation of the motor $M_2$. When the follower 43 closes the contact in the C bank corresponding to the contact in the B bank which has been closed by the contact carrier 55 as the result of attainment by the jib of the newly selected length, the transistors $VT_1$ and $VT_2$ are switched off to stop the motors $M_1$ and $M_2$ and to allow the newly selected cam 44 to descend into contact with the follower 43. When the transistor $VT_2$ is on, it energizes a relay RL1/2 to actuate alarm suppression contacts RL1. The pointer 19 moves on the scale 20 to indicate a reduction in safe working load when the cams 44 are raised by switching on of the transistor $VT_2$. The contacts RL1 accordingly prevent a false alarm signal being given during the periods when the cams 44 are raised.

If the follower 43 should overrun, it will close a contact Cr or Crr to switch on the transistor $VT_3$, via resistors $R_5$ and $R_6$, to energize an overrun relay RL2/4. This shifts contacts RL2 to cause the motor $M_2$ to reverse and cause the follower 43 to return until it closes the contact in the C bank corresponding to the contact in the B bank which has been closed by the contact carrier 55. The transistors $VT_1$, $VT_2$ and $VT_3$ are then switched off.

The lower slide 40 (FIG. 2) carries a pointer which cooperates with a scale, not shown, indicating the reach of the crane. The crane can be converted to angle rating by withdrawing the pin 36 to uncouple the block 37 from the nut on the lead screw 31, shifting the block to the left from the position shown in FIG. 2 and coupling it by the pin directly to the slave jib 26. The scale is then replaced by one indicating the angular position of the jib and the bank of cams 44 is replaced by a single cam appropriate for angle rating. Shifting of the block 37 to the extreme left hand position closes a microswitch 60 (FIG. 4) to cut the electrical control circuit out of operation by establishing a connection independent of that established by the contacts of banks B and C between the point P and the Ov supply line.

What we claim as our invention and desire to secure by Letters Patent is:

1. In a crane having a telescopic jib, means for changing the length of said telescopic jib, an overload warning device having means to warn the crane operator when the load on the jib approaches the maximum safe load on the jib corresponding to any length of the telescopic jib, pointer means for indicating the maximum safe load on the jib for any given jib length by the position of said pointer means, pointer control means including a slave jib which is turned to the same angle with the horizontal as said telescopic jib, a transmission between said slave jib and said pointer means, the improvement comprising a bank of cams, each one of the cams corresponding to a different length of the telescopic jib, a common follower cooperable with said cams to impart movement to said pointer means, and a selector mechanism operable automatically and without manual intervention in response to a change in the length of the telescopic jib for effecting relative movement between the follower and the cams to bring the follower into contact with the cam corresponding to the newly selected jib length.

2. An overload warning device according to claim 1, in which the selector mechanism is electrical and includes a first electric motor which operates in response to change in length of the jib to separate the cams from the follower, a second electric motor which operates to effect relative movement between the follower and the bank of cams and switching mechanism for stopping both motors when the follower arrives opposite the cam corresponding to the new jib length.

3. An overload warning device according to claim 2, which comprises a lead screw rotatably mounted in the slave jib, means for rotating the lead screw in a direction and to an extent corresponding to change in length of the jib, a block movable along the lead screw in response to rotation thereof, a first bank of contacts arranged to be operated selectively in response to movement of the block in accordance with changes in the length of the jib, a second bank of contacts arranged to be operated selectively in accordance with which of the cams is in register with the follower, each contact of the second bank being associated with the cam appropriate for the jib length represented by a corresponding contact in the first bank, and an electrical circuit interconnecting the contacts and the motors and arranged to start the motors in response to lack of correspondence between the operated contacts in the two banks and to stop the motors when the contact operated in the second bank corresponds to the contact operated in the first bank.

4. An overload warning device according to claim 3, wherein the first electric motor is effective to lift the cams from the follower and the second electric motor is effective to traverse the follower across the bank of cams.

5. An overload warning device according to claim 4, which includes a direction relay controlled by the direction of rotation of the lead screw and operative to cause the second electric motor to traverse the follower in the corresponding direction.

6. An overload warning device according to claim 5, which includes an overrun relay operative in response to overrun of the follower to cause the second electric motor to reverse until corresponding contacts in the two banks are operated.

* * * * *